US008690602B2

(12) United States Patent
Flaherty, IV

(10) Patent No.: US 8,690,602 B2
(45) Date of Patent: Apr. 8, 2014

(54) BLIND MATE INTERCONNECT AND CONTACT

(75) Inventor: Thomas Edmond Flaherty, IV, Phoenix, AZ (US)

(73) Assignee: Corning Gilbert Inc., Corning, NY (US)

( * ) Notice: Subject to any disclaimer, the term of this patent is extended or adjusted under 35 U.S.C. 154(b) by 0 days.

(21) Appl. No.: 13/399,396

(22) Filed: Feb. 17, 2012

(65) Prior Publication Data

US 2012/0214357 A1 Aug. 23, 2012

Related U.S. Application Data

(60) Provisional application No. 61/443,957, filed on Feb. 17, 2011, provisional application No. 61/443,858, filed on Feb. 17, 2011, provisional application No. 61/443,864, filed on Feb. 17, 2011.

(51) Int. Cl.
*H01R 9/05* (2006.01)

(52) U.S. Cl.
USPC ..... 439/578

(58) Field of Classification Search
USPC ..... 439/578, 841, 851, 82, 66, 843; 174/108; 257/693
See application file for complete search history.

(56) References Cited

U.S. PATENT DOCUMENTS

| | | | | |
|---|---|---|---|---|
| 3,314,044 | A | 4/1967 | Powell | |
| 4,203,647 | A | 5/1980 | Bonhomme | 339/256 R |
| 4,518,213 | A | 5/1985 | Gallusser | 339/48 |
| 4,925,403 | A | 5/1990 | Zorzy | |
| 5,135,403 | A * | 8/1992 | Rinaldi | 439/82 |
| 5,215,481 | A | 6/1993 | Leisey | 439/851 |
| 5,439,393 | A | 8/1995 | Watson | 439/578 |
| 5,807,147 | A | 9/1998 | Bickford | 439/851 |
| 6,398,593 | B1 | 6/2002 | Yeh | |
| 6,827,608 | B2 | 12/2004 | Hall et al. | |
| 7,112,078 | B2 | 9/2006 | Czikora | |
| 7,128,604 | B2 | 10/2006 | Hall | |
| 7,393,214 | B2 * | 7/2008 | DiStefano | 439/66 |
| 7,478,475 | B2 | 1/2009 | Hall | |
| D595,653 | S * | 7/2009 | Di Stefano | D13/133 |
| 7,579,550 | B2 | 8/2009 | Dayton et al. | 174/108 |
| 7,985,077 | B2 * | 7/2011 | Di Stefano | 439/66 |

(Continued)

FOREIGN PATENT DOCUMENTS

| | | | |
|---|---|---|---|
| DE | 10202637 | C1 | 8/2003 |
| DE | 202008011118 | U1 | 12/2008 |
| DE | 202008011119 | U1 | 12/2008 |
| EP | 1434313 | A1 | 6/2003 |

*Primary Examiner* — Alexander Gilman

(74) *Attorney, Agent, or Firm* — Harness, Dickey & Pierce, PLC

(57) ABSTRACT

A coaxial socket contact for connecting to a coaxial transmission medium to form an electrically conductive path between the transmission medium and the coaxial socket contact, the coaxial socket contact includes a first end and a second end opposite the first end with a tubular body between the first end and the second end, the tubular body having a perimeter and a medial region. The contact further includes at least one slotted region having at least one cantilevered arm extending from the medial region to the first end, the slotted region defining a first length along an axis extending from the first end to the second end, the at least one cantilevered arm defining a second length along the at least one cantilevered arm, the second length being longer than the first length for improving mating cycle performance.

20 Claims, 13 Drawing Sheets

(56) References Cited

U.S. PATENT DOCUMENTS

| | | | | |
|---|---|---|---|---|
| 8,317,539 | B2 | 11/2012 | Stein | |
| 8,323,058 | B2 | 12/2012 | Flaherty et al. | |
| 2004/0038586 | A1 | 2/2004 | Hall et al. | |
| 2006/0051997 | A1 | 3/2006 | Kooiman | |
| 2006/0194465 | A1 | 8/2006 | Czikora | |
| 2006/0258209 | A1 | 11/2006 | Hall | |
| 2008/0194124 | A1* | 8/2008 | Di Stefano | 439/66 |
| 2009/0264003 | A1 | 10/2009 | Hertzler et al. | |
| 2011/0031610 | A1* | 2/2011 | Yamazaki et al. | 257/693 |
| 2011/0151714 | A1 | 6/2011 | Flaherty et al. | |
| 2011/0237123 | A1 | 9/2011 | Burris et al. | |
| 2011/0237124 | A1 | 9/2011 | Flaherty et al. | |

* cited by examiner

BLIND MATE INTERCONNECT AND CONTACT

RELATED APPLICATIONS

This application claims the benefit of priority under 35 U.S.C. §119 of U.S. Provisional Application Ser. No. 61/443,957, U.S. Provisional Application Ser. No. 61/443,864, and U.S. Provisional Application Ser. No. 61/443,858, all filed on Feb. 17, 2011 the content of which is relied upon and incorporated herein by reference in its entirety.

BACKGROUND

1. Field of the Disclosure

The disclosure relates generally to electrical connectors, and particularly to coaxial connectors, and more particularly to blind mate interconnects utilizing coaxial socket contacts having cantilevered arms that wrap around a central axis for improving mating cycle performance.

2. Technical Field

The technical field of coaxial connectors, including microwave frequency connectors, includes connectors designed to transmit electrical signals and/or power. Male and female interfaces may be engaged and disengaged to connect and disconnect the electrical signals and/or power.

These interfaces typically utilize socket contacts that are designed to engage pin contacts. These metallic contacts are generally surrounded by a plastic insulator with dielectric characteristics. A metallic housing surrounds the insulator to provide electrical grounding and isolation from electrical interference or noise. These connector assemblies may be coupled by various methods including a push-on design.

The dielectric properties of the plastic insulator along with its position between the contact and the housing produce an electrical impedance, such as 50 ohms. Microwave or radio frequency (RF) systems with a matched electrical impedance are more power efficient and therefore capable of improved electrical performance.

DC connectors utilize a similar contact, insulator, and housing configuration. DC connectors do not required impedance matching. Mixed signal applications including DC and RF are common.

Connector assemblies may be coupled by various methods including a push-on design. The connector configuration may be a two piece system (male to female) or a three piece system (male to female-female to male). The three piece connector system utilizes a double ended female interface known as a blind-mate interconnect (BMI). The BMI includes a double ended socket contact, two or more insulators, and a metallic housing with grounding fingers. The three piece connector system also utilizes two male interfaces each with a pin contact, insulator, and metallic housing called a shroud. The insulator of the male interface is typically plastic or glass. The shroud may have a detent feature that engages the front fingers of the BMI metallic housing for mated retention. This detent feature may be modified thus resulting in high and low retention forces for various applications. The three piece connector system enables improved electrical and mechanical performance during radial and axial misalignment.

Socket contacts are a key component in the transmission of the electrical signal. Conventional socket contacts used in coaxial connectors, including microwave frequency connectors, typically utilize a straight or tapered beam design that requires time consuming traditional machining and forming techniques. Such contacts, upon engagement, typically result in a non-circular cross section, such as an oval, triangular, square or other simple geometric cross section, depending on the number of beams. These non-circular cross sections may result in degraded electrical performance. In addition, when exposed to forces that cause mated misalignment of pin contacts, conventional beam sockets tend to flare and may, therefore, degrade the contact points. In such instances, conventional beam sockets may also lose contact with the contact pins or become distorted, causing damage to the beams or a degradation in RF performance. What is needed is a coaxial socket contact with reliable mating characteristics that can withstand repeated mating cycles without degradation of mechanical and electrical performance.

SUMMARY

An aspect of the disclosure is a coaxial socket contact for connecting to a coaxial transmission medium to form an electrically conductive path between the transmission medium and the coaxial socket contact having improved mating performance includes a first end, a second end opposite the first end and a tubular body between the first end and the second end, the tubular body having a perimeter and a medial region. The socket contact may include at least one slotted region and at least one cantilevered arm extending from the medial region to at least the first end. The slotted region may define a first length along an axis extending from the first end to the second end. The at least one cantilevered arm may define a second length along the at least one cantilevered arm, the second length may be longer than the first length for improving mating cycle performance.

In one embodiment, the second length may be from 100 percent to about 200 percent of the first length. In another embodiment, the second length may be from 100 percent to about 150 percent of the first length. In another embodiment, the second length may be from 100 percent to about 125 percent the first length, and in yet another embodiment, the second length may be from 100 percent to about 110 percent of the first length.

In some embodiments, the at least one cantilevered arm may include at least one angular cantilevered arm that extends from the medial region to at least the first end, the at least one angular cantilevered arm extending at an angle greater than zero degrees to the axis.

In another embodiment, the at least on angular cantilevered arm may wrap around the axis as the arm extends from the medial region to the first end. In yet another embodiment, the at least one angular cantilevered arm may wrap around the axis at a distance of from about 0.003 inches to about 0.005 inches from the axis as the arm extends from the medial region to at least the first end.

In some embodiments, the at least one angular cantilevered arm may define a plurality of angular cantilevered arms arranged in at least one radial array.

In some embodiments, the angular cantilevered arm may extend from the medial region at an angle less than 90 degrees relative to the axis.

Additional features and advantages will be set forth in the detailed description which follows, and in part will be readily apparent to those skilled in the art from that description or recognized by practicing the embodiments as described herein, may include the detailed description which follows, the claims, as well as the appended drawings.

It is to be understood that both the foregoing general description and the following detailed description present exemplary embodiments, and are intended to provide an overview or framework for understanding the nature and character of the claims. The accompanying drawings are included to provide a further understanding, and are incorporated into and constitute a part of this specification. The drawings illustrate various embodiments, and together with the description serve to explain the principles and operations of the various embodiments.

DETAILED DESCRIPTION

Figure 1:
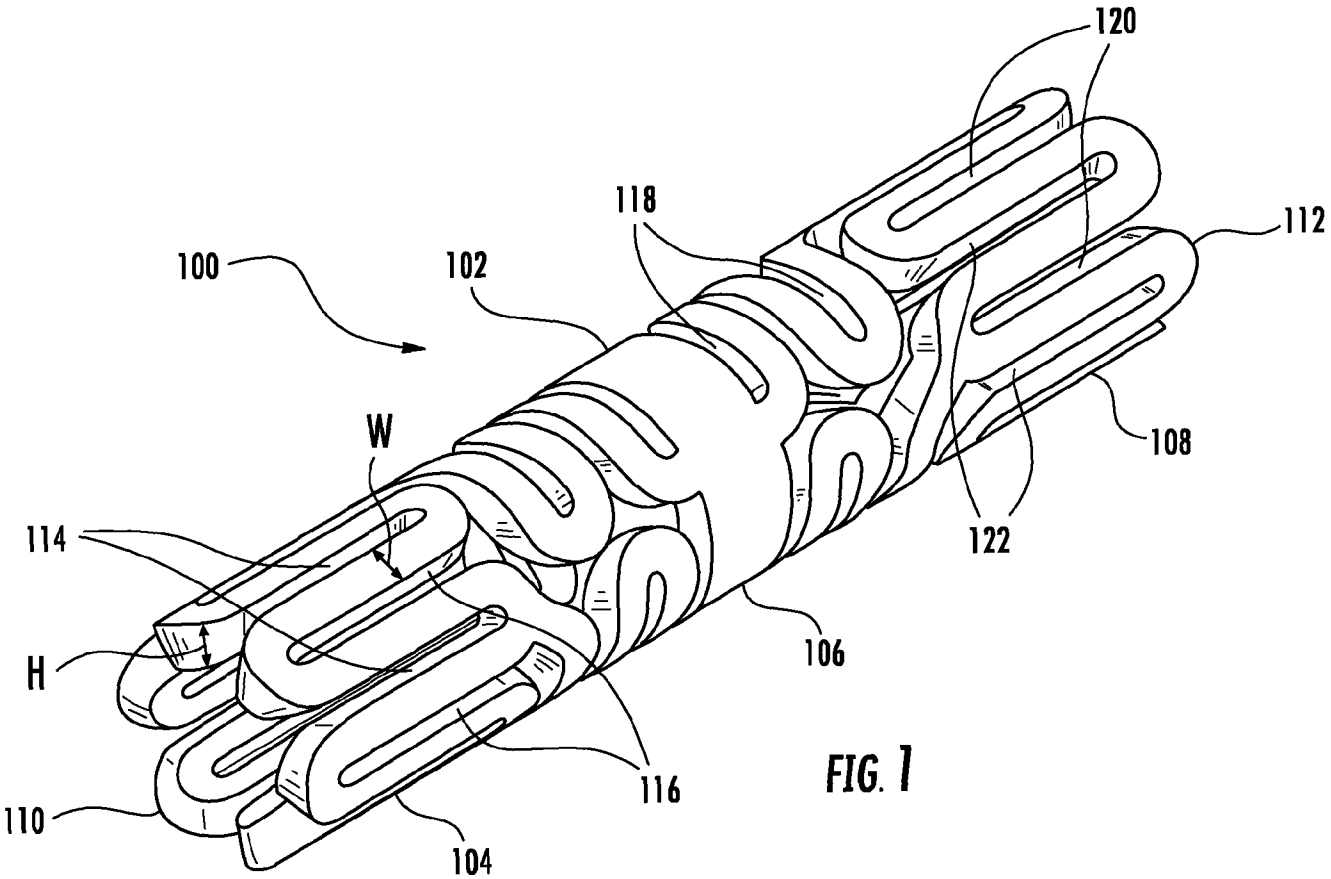
FIG. 1 is a perspective view of an embodiment of a socket contact as disclosed herein.

Reference is now made in detail to the present embodiments of the disclosure, examples of which are illustrated in the accompanying drawings. Whenever possible, identical or similar reference numerals are used throughout the drawings to refer to identical or similar parts. It should be understood that the embodiments disclosed herein are merely examples with each one incorporating certain benefits of the present disclosure. Various modifications and alterations may be made to the following examples within the scope of the present disclosure, and aspects of the different examples may be mixed in different ways to achieve yet further examples. Accordingly, the true scope of the disclosure is to be understood from the entirety of the present disclosure in view of, but not limited to the embodiments described herein.

In an exemplary embodiment, a socket contact 100 may include a main body 102 extending along a longitudinal axis (FIG. 1). Main body 102 may have a proximal portion 104, a distal portion 108, and a central portion 106 that may be axially between proximal portion 104 and distal portion 108. Each of proximal portion 104, distal portion 108, and central portion 106 may have inner and outer surfaces. Main body 102 may also have a first end 110 disposed on proximal portion 104 and an opposing second end 112 disposed on distal portion 108. Main body 102 may be comprised of electrically conductive and mechanically resilient material having spring-like characteristics, for example, that extends circumferentially around the longitudinal axis. Materials for main body 102 may include, but are not limited to, gold plated beryllium copper (BeCu), stainless steel, or a cobalt-chromium-nickel-molybdenum-iron alloy such as Conichrome, Phynox, and Elgiloy. An exemplary material for main body 102 may be gold plated beryllium copper (BeCu).

In exemplary embodiments, socket contact 100 may include a plurality of external openings 114 associated with proximal portion 104. In exemplary embodiments, at least one of external openings 114 extends for a distance from, for example, first end 110, along at least a part of the longitudinal length of proximal portion 104 between the inner and outer surfaces of proximal portion 104. Socket contact 100 may include at least one internal opening 116, for example, that may be substantially parallel to openings 114, but does not extend to first end 110. In further exemplary embodiments (FIG. 1), socket contact 100 may also include other external openings 120 associated with distal portion 108. In exemplary embodiments, at least one of external openings 120 extends for a distance from, for example, second end 112, along at least a part of the longitudinal length of distal portion 108 between the inner and outer surfaces of distal portion 108. Socket contact 100 may further include at least one other internal opening 122, for example, that may be substantially parallel to openings 120, but does not extend to second end 112.

In exemplary embodiments (FIG. 1), the openings extending along the longitudinal length of portions 104 and 108 delineate, for example, longitudinally oriented u-shaped slots. Specifically, openings 114, 120 respectively extending from ends 110, 112 and openings 116, 122 respectively not extending to ends 110, 122 delineate longitudinally oriented u-shaped slots. In exemplary embodiment, socket contact 100 may include circumferentially oriented u-shaped slots delineated by a plurality of openings 118 extending at least partially circumferentially around central portion 106. The circumferentially oriented u-shaped slots may be generally perpendicular to longitudinally oriented u-shaped slots.

In exemplary embodiments, the longitudinally oriented u-shaped slots delineated by openings 114, 116 and 120, 122 alternate in opposing directions such that, along the proximal portion 104 and distal portion 108. In other words, the electrically conductive and mechanically resilient material circumferentially extends around the longitudinal axis, for example, in a substantially axially parallel accordion-like pattern, along the proximal portion 104 and distal portion 108

(FIG. 1). The radially outermost portion of electrically conductive and mechanically resilient material has a width, W, that in exemplary embodiments, may be approximately constant along different portions of the axially parallel accordion-like pattern. Additionally, the radially outermost portion of electrically conductive and mechanically resilient material has a height, H. In exemplary embodiments, height H may be approximately constant along different portions of the pattern. In further exemplary embodiments, the ratio of H/W may be from about 0.5 to about 2.0, such as from about 0.75 to about 1.5, including about 1.0.

In exemplary embodiments, main body 102 may be of unitary construction. In an exemplary embodiment, main body 102 may be constructed from, for example, a thin-walled cylindrical tube of electrically conductive and mechanically resilient material. For example, patterns have been cut into the tube (FIG. 1), such that the patterns define, for example, a plurality of openings that extend between the inner and outer surfaces of the tube. The thin wall tube may be fabricated to small sizes (for applications where, for example, small size and low weight are of importance) by various methods including, for example, extruding, drawing, and deep drawing, etc. The patterns may, for example, be laser machined, stamped, etched, electrical discharge machined or traditionally machined into the tube depending on the feature size. In exemplary embodiments, for example, the patterns are laser machined into the tube.

Figure 2:
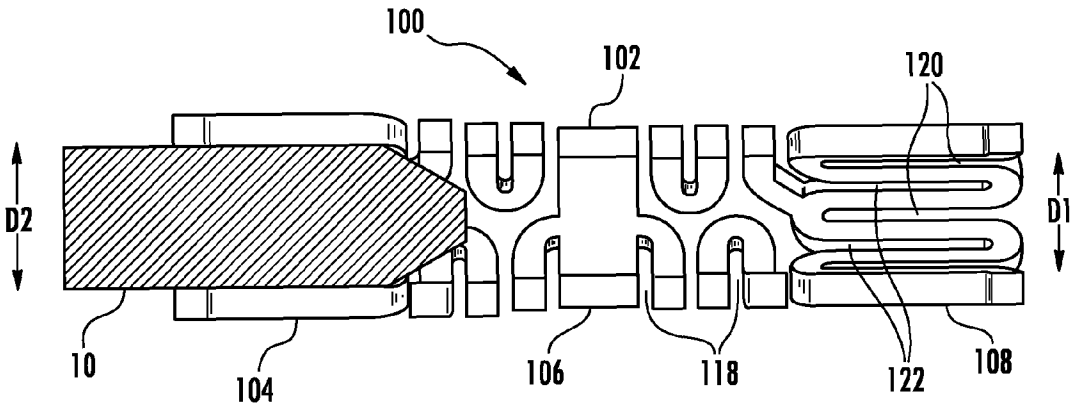
FIG. 2 is a side cutaway view of the socket contact illustrated in FIG. 1, wherein the socket is shown engaging a male pin contact.

In exemplary embodiments, socket contact 100 may engage a coaxial transmission medium, for example, a mating (male pin) contact 10 (FIG. 2). An inner surface of proximal portion 104 and an inner surface of distal portion 108 may each be adapted to engage, for example, circumferentially, an outer surface of mating contact 10. Prior to engagement with mating contact 10, proximal portion 104 and distal portion 108 each have an inner width, or diameter, D1 that may be smaller than an outer diameter D2 of mating contact 10. In some embodiments, engagement of the inner surface of proximal portion 104 or distal portion 108 with outer surface of mating contact 10 may cause portions 104 and 108 to flex radially outwardly. As an example, during such engagement, the inner diameter of proximal portion 104 and/or distal portion 108 may be at least equal to D2 (FIG. 2). In the example, inner diameter of proximal portion 104 may be approximately equal to D2 upon engagement with mating contact 10 while distal portion 108 not being engaged to a mating contact may have an inner diameter of D1. Disengagement of the inner surface of proximal portion 104 and/or distal portion 108 with the outer surface of mating contact 10 may cause inner diameter of proximal portion 104 and/or distal portion 108 to return to D1. While not limited, D2/D1 may be, in exemplary embodiments, at least 1.05, such as at least 1.1, and further such as at least 1.2, and yet further such as at least 1.3. The outward radial flexing of proximal portion 104 and/or distal portion 108 during engagement with mating contact 10 may result in a radially inward biasing force of socket contact 100 on mating contact 10, facilitating transmission of an electrical signal between socket contact 100 and mating contact 10 and also reducing the possibility of unwanted disengagement between socket contact 100 and mating contact 10.

In exemplary embodiments, the inner surface of proximal portion 104 and the inner surface of distal portion 108 are adapted to contact the outer surface of mating contact 10 upon engagement with mating contact 10. In exemplary embodiments, proximal portion 104 and distal portion 108 may each have a circular or approximately circular shaped cross-section of uniform or approximately uniform inner diameter of D1 along their longitudinal lengths prior to or subsequent to engagement with mating contact 10. In exemplary embodiments, proximal portion 104 and distal portion 108 may each have a circular or approximately circular shaped cross-section of uniform or approximately uniform inner diameter of at least D2 along a length of engagement with mating contact 10. Put another way, the region bounded by inner surface of proximal portion 104 and the area bounded by inner surface of distal portion 108 each, in exemplary embodiments, approximates that of a cylinder having a diameter of D1 prior to or subsequent to engagement with mating contact 10, and the region bounded by inner surface of proximal portion 104 and the area bounded by inner surface of distal portion 108 each, in exemplary embodiments, approximates that of a cylinder having a diameter of D2 during engagement with mating contact 10.

Figure 3:
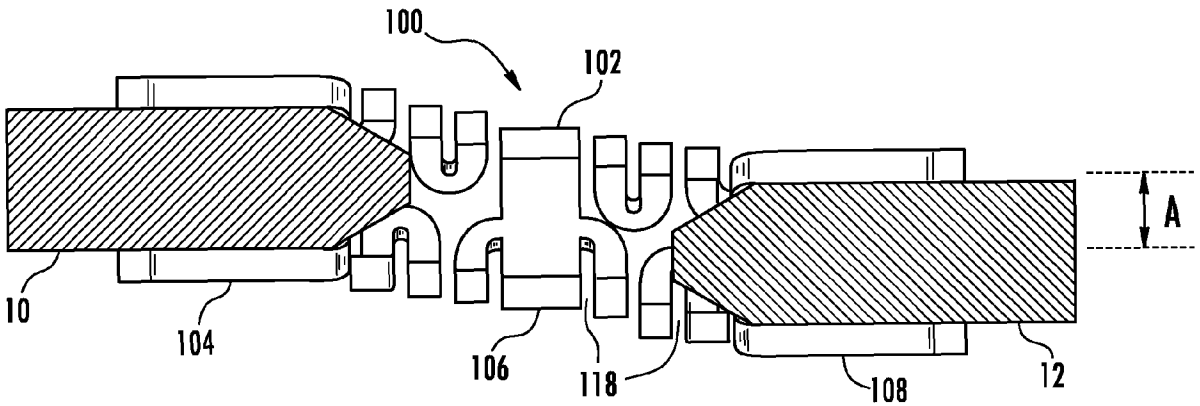
FIG. 3 is a side cutaway view of the socket contact illustrated in FIG. 1, wherein the socket is shown engaging two non-coaxial male pin contacts.

In one embodiment, socket contact 100 may simultaneously engage two mating (male pin) contacts 10 and 12 (FIG. 3). Mating contact 10 may, for example, circumferentially engage proximal portion 104 and mating contact 12 may circumferentially engage distal portion 108. In some embodiments, mating contact 10 may not be coaxial with mating contact 12, resulting in an axial offset distance A (or mated misalignment) between the longitudinal axis of mating contact 10 and the longitudinal axis of mating contact 12 (FIG. 3).

In exemplary embodiments, socket contact 100 may be adapted to flex, for example, along central portion 106, compensating for mating misalignment between, for example, mating contact 10 and mating contact 12. Types of mating misalignment may include, but are not limited to, radial misalignment, axial misalignment and angular misalignment. For purposes of this disclosure, radial misalignment may be defined as the distance between the two mating pin (e.g., mating contact) axes and may be quantified by measuring the radial distance between the imaginary centerline of one pin if it were to be extended to overlap the other pin. For purposes of this disclosure, axial misalignment may be defined as the variation in axial distance between the respective corresponding points of two mating pins. For purposes of this disclosure, angular misalignment may be defined as the effective angle between the two imaginary pin centerlines and may usually be quantified by measuring the angle between the pin centerlines as if they were extended until they intersect. Additionally, and for purposes of this disclosure, compensation for the presence of one, two or all three of the stated types of mating misalignments, or any other mating misalignments, may be simply characterized by the term "gimbal" or "gimballing." Put another way, gimballing may be described for purposes of this disclosure as freedom for socket contact 100 to bend or flex in any direction and at more than one location along socket contact 100 in order to compensate for any mating misalignment that may be present between, for example, a pair of mating contacts or mating pins, such as mating contacts 10, 12. In exemplary embodiments, socket contact 100 may gimbal between, for example, mating contact 10 and mating contact 12 while still maintaining radially inward biasing force of socket contact 100 on mating contacts 10 and 12. The radially inward biasing force of socket contact 100 on mating contacts 10, 12 facilitates transmission of, for example, an electrical signal between socket contact 100 and mating contacts 10 and 12 and reduces the possibility of unwanted disengagement during mated misalignment.

In exemplary embodiments, when mating contact 10 is not coaxial with mating contact 12, the entire inner surface of proximal portion 104 and the entire inner surface of distal portion 108 are adapted to contact the outer surface of mating contacts 10 and 12 upon engagement with mating contacts 10 and 12. In exemplary embodiments, each of proximal portion 104 and distal portion 108 may have a circular or approximately circular shaped cross-section of a nominally uniform inner diameter of D1 along their respective longitudinal lengths prior to or subsequent to engagement with mating contacts 10 and 12. Additionally, each of proximal portion 104 and distal portion 108 may have a circular or approximately circular shaped cross-section of a nominally uniform inner diameter of at least D2 along their longitudinal lengths during engagement with mating contacts 10 and 12. Put another way, the space bounded by inner surface of proximal portion 104 and the space bounded by inner surface of distal portion 108 each, in exemplary embodiments, approximates that of a cylinder having a nominal diameter of D1 prior to or subsequent to engagement with mating contacts 10 and 12 and the space bounded by inner surface of proximal portion 104 and the space bounded by inner surface of distal portion 108 each, in exemplary embodiments, approximates that of a cylinder having a nominal diameter of D2 during engagement with mating contacts 10 and 12.

In exemplary embodiments, socket contact 100 may gimbal to compensate for a ratio of axial offset distance A to nominal diameter D1, A/D1, to be at least about 0.4, such as at least about 0.6, and further such as at least about 1.2. In further exemplary embodiments, socket contact 100 may gimbal to compensate for a ratio of axial offset distance A to nominal diameter D2, A/D2 to be at least about 0.3, such as at least about 0.5, and further such as at least about 1.0. In exemplary embodiments, socket contact 100 may gimbal to compensate for the longitudinal axis of mating contact 10 to be substantially parallel to the longitudinal axis of mating contact 12 when mating contacts 10 and 12 are not coaxial, for example, such as when A/D2 may be at least about 0.3, such as at least about 0.5, and further such as at least about 1.0. In further exemplary embodiments, socket contact 100 may gimbal to compensate for the longitudinal axis of mating contact 10 to be substantially oblique to the longitudinal axis of mating contact 12 when mating contacts 10 and 12 are not coaxial, for example, when the relative angle between the respective longitudinal axes is not 180 degrees.

Figure 4:
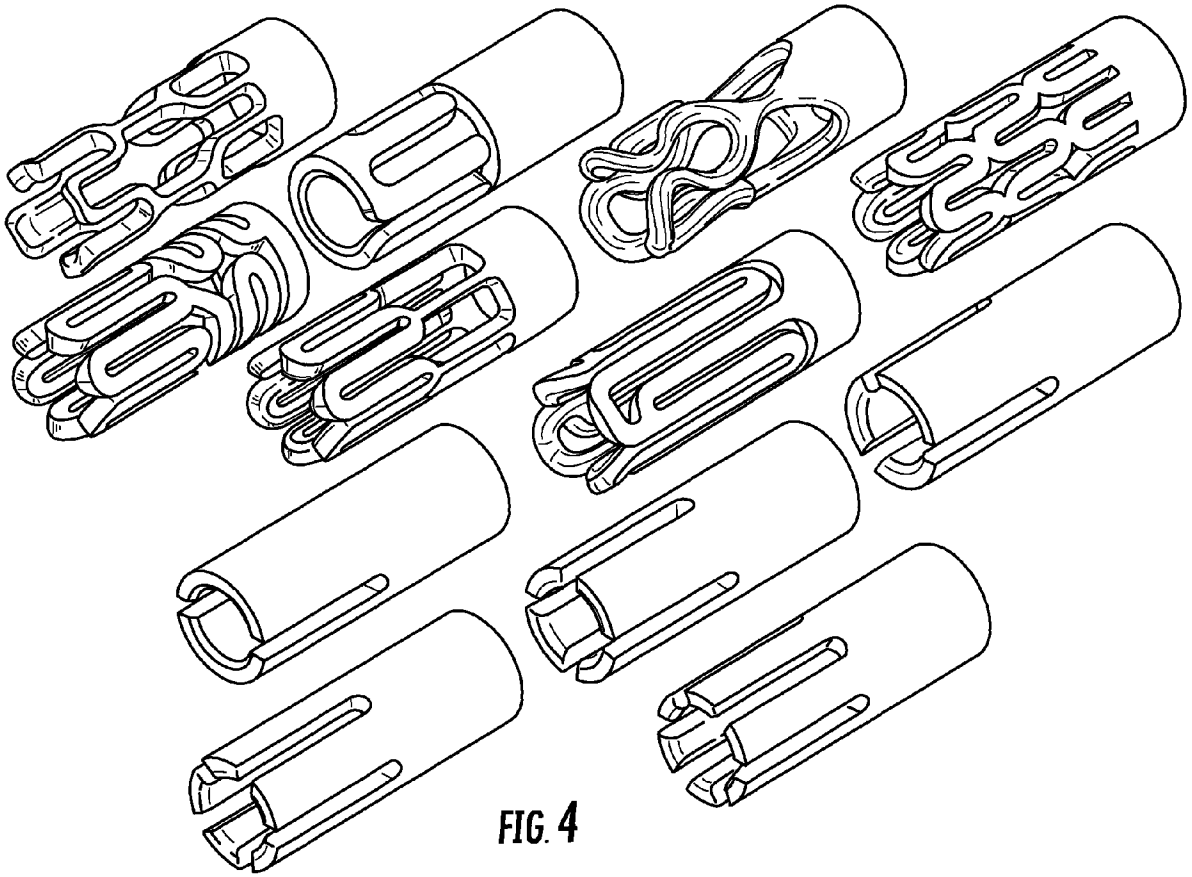
FIG. 4 is perspective views of alternate embodiments of socket contacts as disclosed herein.

Alternate embodiments may include, for example, embodiments having openings cut into only a single end (FIG. 4). So called single ended variations (FIG. 4) may have the proximal portion of the socket adapted to engage, for example, a pin contact and the distal portion of the socket may, for example, be soldered or brazed to, for example, a wire, or, for example, soldered, brazed, or welded to another such contact as, for example, another socket/pin configuration. As with the socket contact 100 (see FIGS. 1-3), the single ended socket contact variations (FIG. 4) may be adapted to flex radially and axially along at least a portion of their longitudinal length. The different patterns on the single ended socket contacts (FIG. 4) may also be found on double ended embodiments, similar to socket contact 100 (see FIGS. 1-3).

Figure 5:
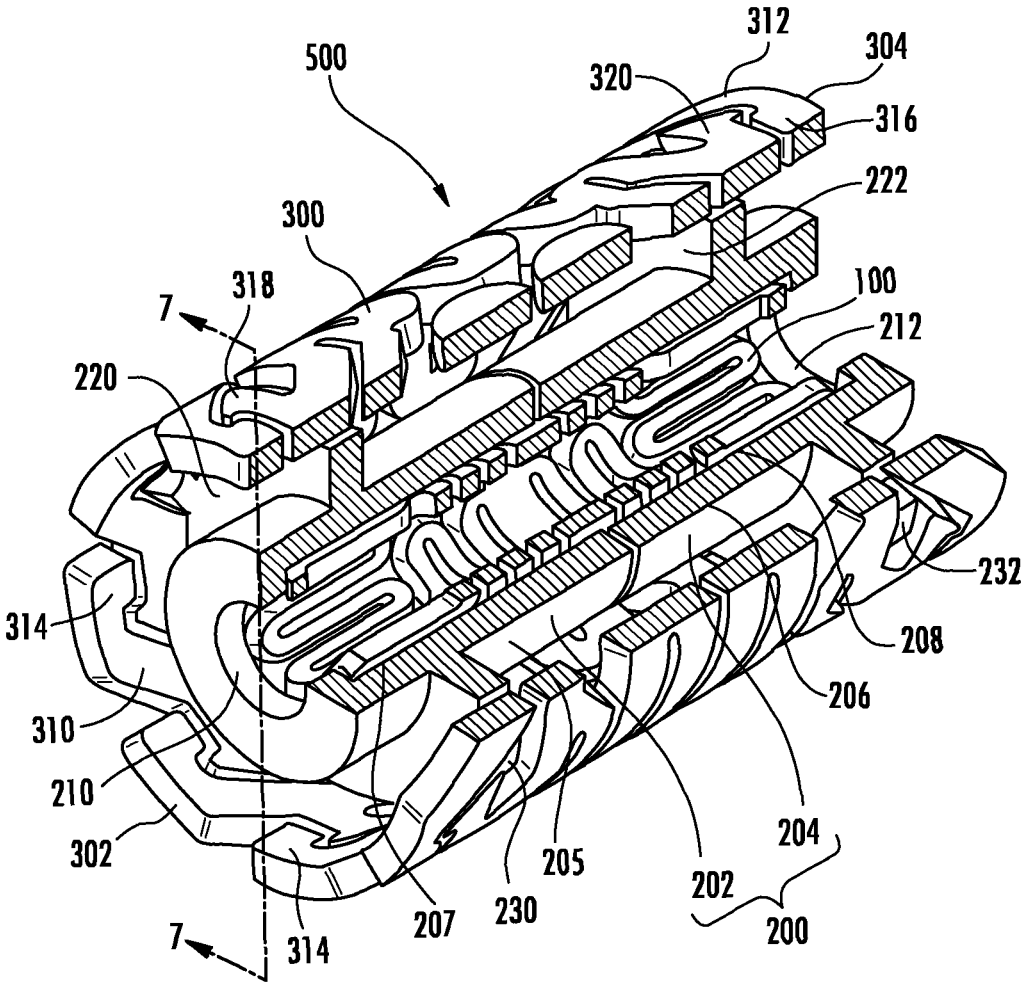
FIG. 5 is a cutaway isometric view of a blind mate interconnect having an outer conductor, an insulator and the socket contact of FIG. 1.
Figure 6:
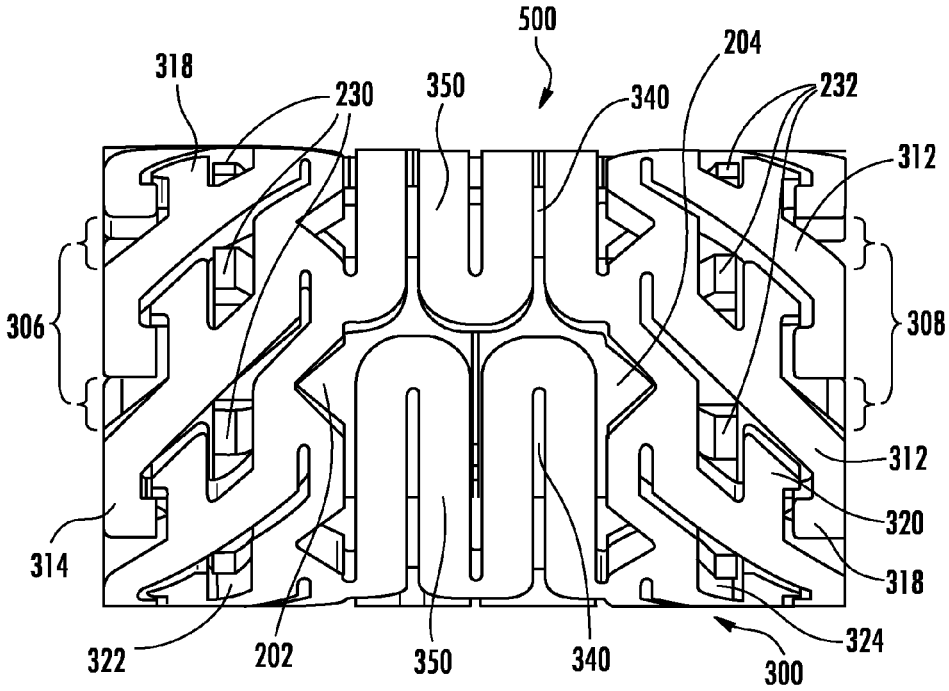
FIG. 6 is a side view of the blind mate interconnect of FIG. 5.

A blind mate interconnect (BMI) 500 (FIGS. 5-7) as disclosed may include, for example, socket contact 100, an insulator 200, and an outer conductor 300. Outer conductor 300 may extend substantially circumferentially about a longitudinal axis and may define a first central bore. Insulator 200 may be disposed within the first central bore and may extend substantially about the longitudinal axis. Insulator 200 may include a first insulator component 202 and second insulator component 204 that may, for example, cooperate to define a second central bore. In exemplary embodiments, socket contact 100 may be disposed within the second central bore.

Outer conductor 300 may have a proximal end 302 and a distal end 304, with, for example, a tubular body extending between proximal end 302 and distal end 304. In an exemplary embodiment, a first radial array of slots 306 may extend substantially diagonally, or helically, along the tubular body of conductor 300 from proximal end 302 for a distance, and a second radial array of slots 308 may extend substantially diagonally, or helically, along the tubular body of conductor 300 from proximal end 304 for a distance. Slots 306, 308 may provide a gap having a minimum width of about 0.001 inches. Outer contact, being made from an electrically conductive material, may optionally be plated, for example, by electroplating or by electroless plating, with another electrically conductive material, e.g., nickel and/or gold. The plating may add material to the outer surface of outer conductor 300, and may close the gap to about 0.00075 inches nominal In exemplary embodiments, helical slots may be cut at an angle of, for example, less than 90 degrees relative to the longitudinal axis (not parallel to the longitudinal axis), such as from about 30 degrees to about 60 degrees relative to the longitudinal axis, and such as from about 40 degrees to about 50 degrees relative to the longitudinal axis.

Slots 306 and 308 may define, respectively, a first array of substantially helical cantilevered beams 310 and a second array of substantially helical cantilevered beams 312. Helical cantilevered beams 310, 312 include, for example, at least a free end and a fixed end. In exemplary embodiments, first array of substantially helical cantilevered beams 310 may extend substantially helically around at least a portion of proximal end 302 and a second array of substantially helical cantilevered beams 312 extend substantially helically around at least a portion of distal end 304. Each of helical cantilevered beams 310 may include, for example, at least one retention finger 314 and at least one flange stop 316 and each of plurality of second cantilevered beams 312 includes at least one retention finger 318 and at least one flange stop 320. Slots 306 and 308 each may define at least one flange receptacle 322 and 324, respectively. In an exemplary embodiment, flange receptacle 322 may be defined as the space bounded by flange stop 316, two adjacent helical cantilevered beams 310, and the fixed end for at least one of helical cantilevered beams 310. In an exemplary embodiment, flange receptacle 324 may be defined as the space bounded by flange stop 318, two adjacent helical cantilevered beams 314, and the fixed end for at least one of helical cantilevered beams 314. Helical cantilevered beams 310 and 312, in exemplary embodiments, may deflect radially inwardly or outwardly as they engage an inside surface or an outside surface of a conductive outer housing of a coaxial transmission medium (see, e.g., FIGS. 8 and 12), for example, providing a biasing force for facilitating proper grounding.

Outer conductor 300 may include, for example, at least one radial array of sinuate cuts at least partially disposed around the tubular body. the cuts delineating at least one radial array of sinuate sections, the sinuate sections cooperating with the at least one array of substantially helical cantilevered beams to compensate for misalignment within a coaxial transmission medium, the conductor comprising an electrically conductive material First insulator component 202 may include outer surface 205, inner surface 207 and reduced diameter portion 210. Second insulator component 204 includes outer surface 206, inner surface 208 and reduced diameter portion 212. Reduced diameter portions 210 and 212 allow insulator 200 to retain socket contact 100. In addition, reduced diameter portions 210 and 212 provide a lead in feature for mating contacts 10 and 12 (see, e.g., FIG. 8) to facilitate engagement between socket contact 100 and mating contacts 10 and 12. First insulator component 202 additionally may include an increased diameter portion 220 and second insulator component 204 may also include an increased diameter portion 222 (FIG. 8), increased diameter portions 220, 222 may respectively have at least one flange 230 and 232 that engages outer conductor 300, specifically, respective flange receptacles 322 and 324 (see FIG. 6).

Figure 7:
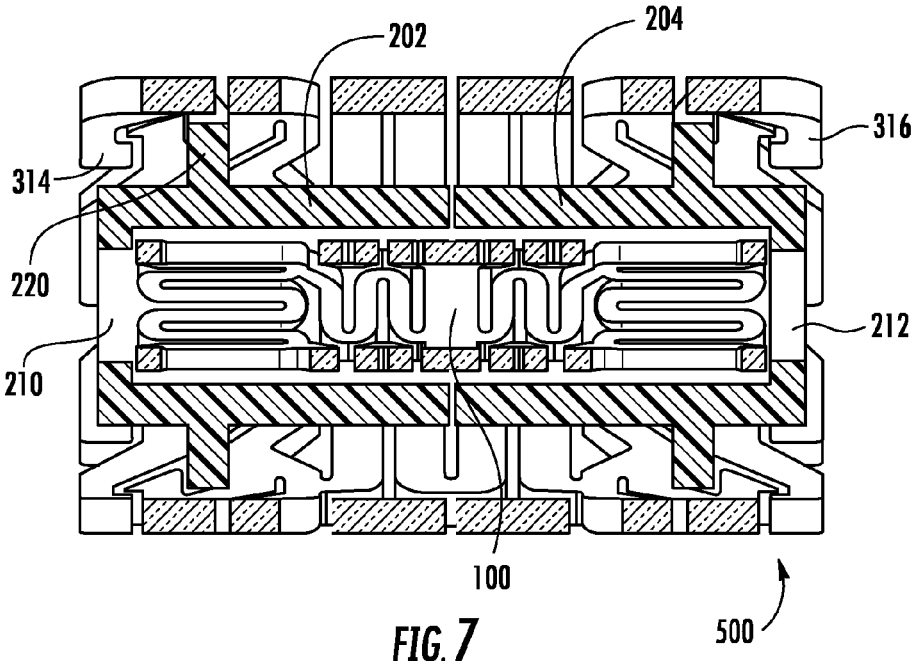
FIG. 7 is a side cross sectional view of the blind mate interconnect of FIG. 5.

In exemplary embodiments, each of first and second insulator components 202 and 204 are retained in outer conductor portion 300 by first being slid longitudinally from the respective proximal 302 or distal end 304 of outer conductor portion 300 toward the center of outer conductor portion 300 (FIG. 7). First array of substantially helical cantilevered beams 310 and second array of substantially helical cantilevered beams 312 may be flexed radially outward to receive respective arrays of flanges 230 and 232 within respective flange receptacles 322, 324. In exemplary embodiments, flanges 230, 232 reside freely within respective flange receptacles 322, 324, and may not react radially in the event cantilevered beams 310, 312 flex, but may prevent relative axial movement during connection of first and second insulator components 202 and 204 as a connector is pushed or pulled against interconnect 500.

In exemplary embodiments outer conductor portion 300 may be made, for example, of a mechanically resilient electrically conductive material having spring-like characteristics, for example, a mechanically resilient metal or metal alloy. An exemplary material for the outer conductor portion 300 may be beryllium copper (BeCu), which may optionally be plated over with another material, e.g., nickel and/or gold. Insulator 200, including first insulator component 202 and second insulator component 204, may be, in exemplary embodiments, made from a plastic or dielectric material. Exemplary materials for insulator 200 include Torlon® (polyamide-imide), Vespel® (polyimide), and Ultem (Polyetherimide). Insulator 200 may be, for example, machined or molded. The dielectric characteristics of the insulators 202 and 204 along with their position between socket contact 100 and outer conductor portion 300 produce, for example, an electrical impedance of about 50 ohms. Fine tuning of the electrical impedance may be accomplished by changes to the size and/or shape of the socket contact 100, insulator 200, and/or outer conductor portion 300.

Figure 8:
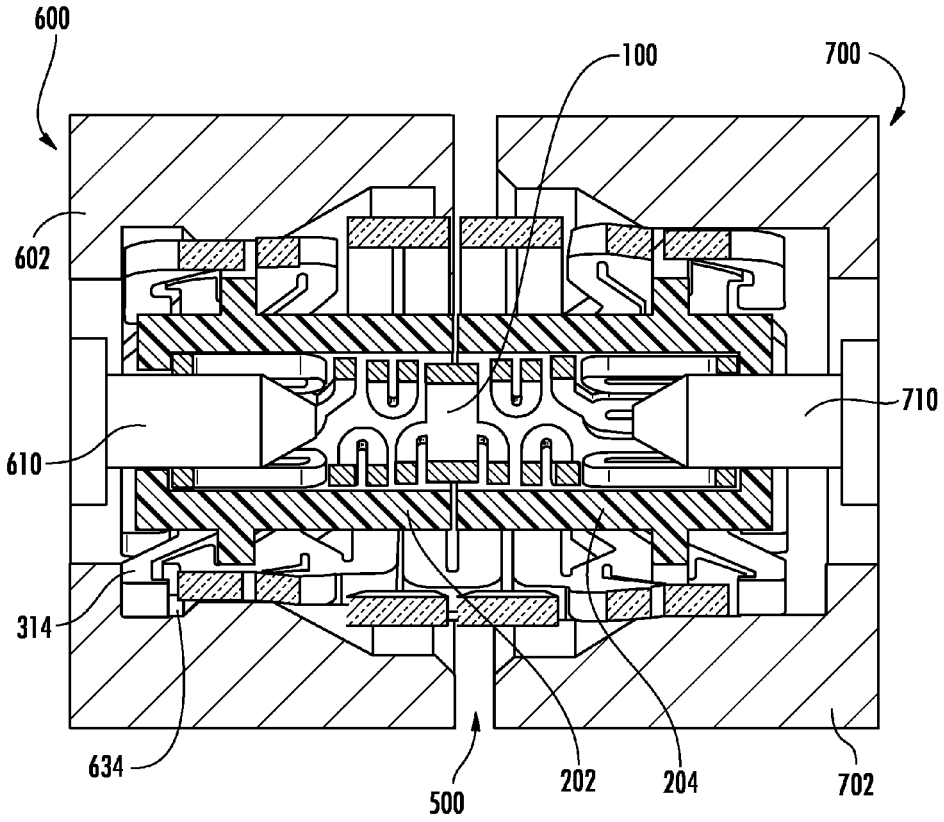
FIG. 8 is another cross sectional view of the blind mate interconnect of FIG. 5 mated with two coaxial transmission mediums.
Figure 10:
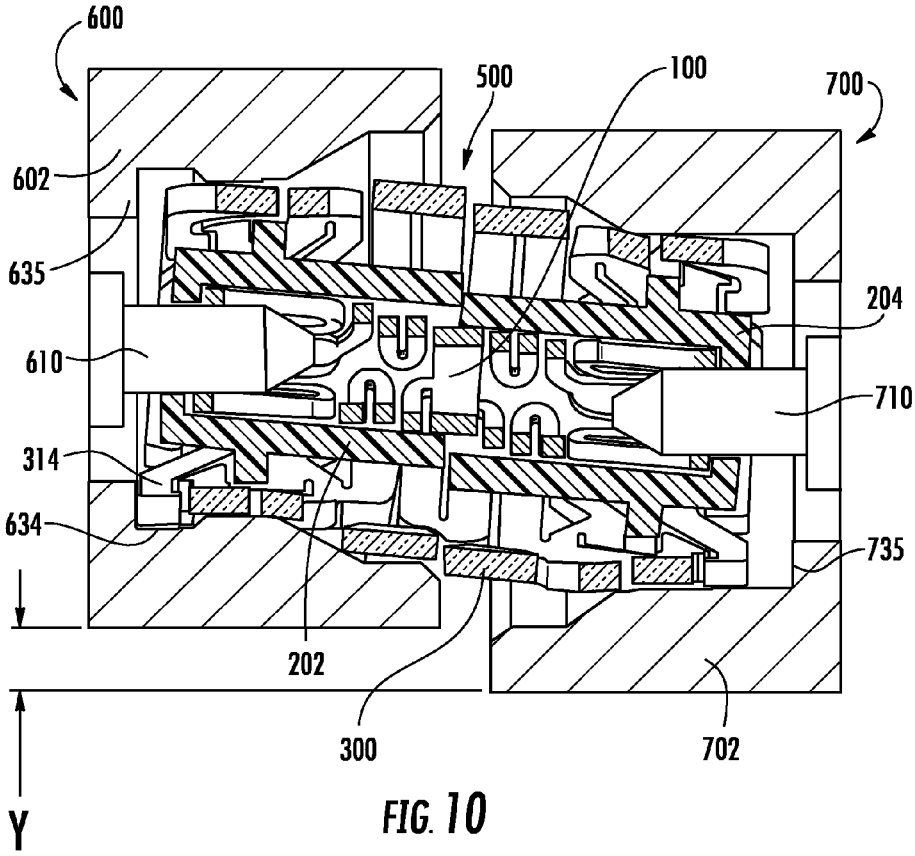
FIG. 10 is a mated side cross sectional view of the is a side cross sectional view showing an increased radial misalignment possible with the blind mate interconnect of FIG. 5.

Connector 500 may engage with two coaxial transmission mediums, e.g., first and second male connectors 600 and 700, having asymmetrical interfaces (FIG. 8). First male connector 600 may be a detented connector and may include a conductive outer housing (or shroud) 602 extending circumferentially about a longitudinal axis, an insulator circumferentially surrounded by the conductive outer housing 602, and a conductive mating contact (male pin) 610 at least partially circumferentially surrounded by the insulator. Second male connector 700 may be, for example, a non-detented or smooth bore connector and also includes a conductive outer housing (or shroud) 702 extending circumferentially about a longitudinal axis, an insulator circumferentially surrounding by the conductive outer housing 702, and a conductive mating contact (male pin) 710 at least partially circumferentially surrounded by insulator 705. Outer conductor 300 may compensate for mating misalignment by one or more of radially expanding, radially contracting, axially compressing, axially stretching, bending, flexing, or combinations thereof Mating misalignment may be integral to a single connector, for example, male connectors 600 or 700 or between two connectors, for example, both connectors 600 and 700. For example, the array of retention fingers 314 located on the free end of the first array of cantilevered beams 310 may snap into a detent 634 of outer shroud 602, securing interconnect 500 into connector 600. Male pin 610 engages and makes an electrical connection with socket contact 100 housed within insulator 202. Any misalignment that may be present between male pin 610 and outer shroud 602 may be compensated by interconnect 500. A second connector, for example, connector 700, that may be misaligned relative to first connector 600 is compensated for by interconnect 500 in the same manner (see FIG. 10).

Connector 500 may engage with two coaxial transmission mediums, e.g., first and second male connectors 600 and 700, having asymmetrical interfaces (FIG. 8). First male connector 600 may be a detented connector and may include a conductive outer housing (or shroud) 602 extending circumferentially about a longitudinal axis, an insulator 605 circumferentially surrounded by the conductive outer housing 602, and a conductive mating contact (male pin) 610 at least partially circumferentially surrounded by insulator 605. Second male connector 700 may be, for example, a non-detented or smooth bore connector and also includes a conductive outer housing (or shroud) 702 extending circumferentially about a longitudinal axis, an insulator 705 circumferentially surrounding by the conductive outer housing 702, and a conductive mating contact (male pin) 710 at least partially circumferentially surrounded by insulator 705.

Figure 9:
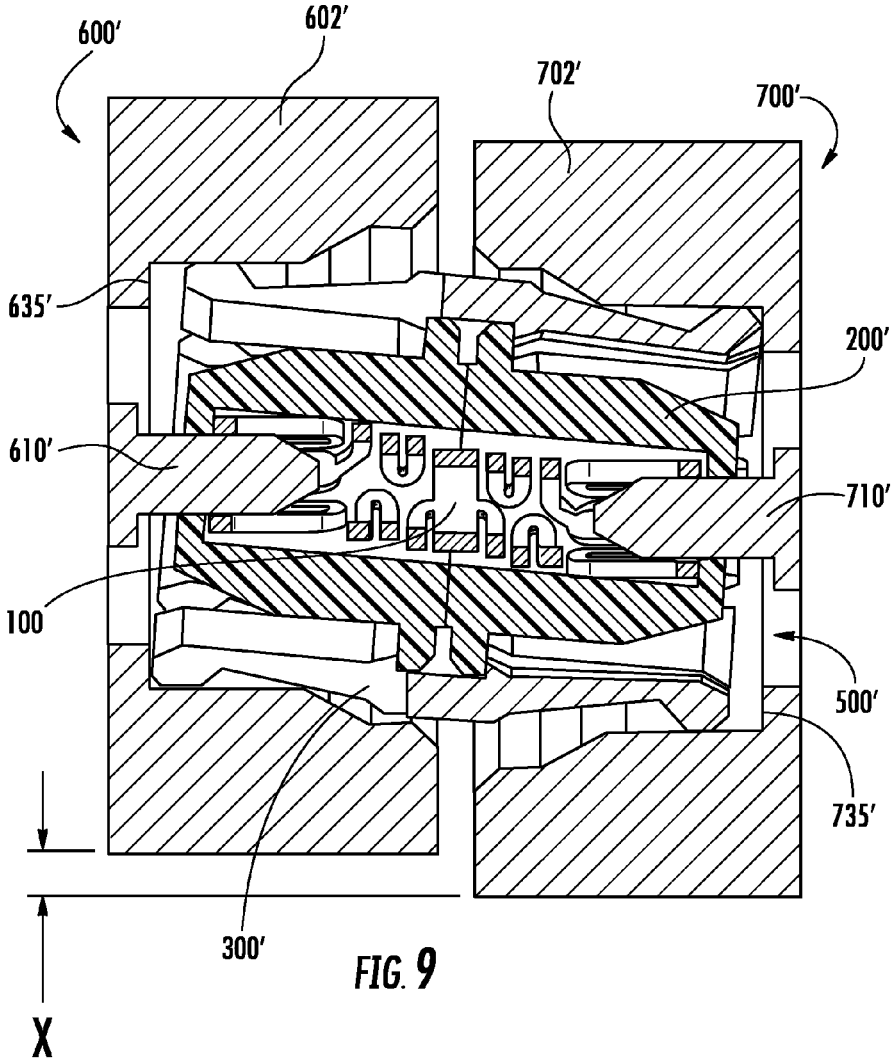
FIG. 9 is a mated side cross sectional view of a prior art interconnect showing a maximum amount of radial misalignment possible with the prior art interconnect.

In an alternate embodiment, a blind mate interconnect 500' having a less flexible outer conductor 300' may engage with two non-coaxial (misaligned) male connectors 600' and 700 (FIG. 9). Male connector 600' may act as a coaxial transmission medium and may include a conductive outer housing (or shroud) 602' extending circumferentially about a longitudinal axis, an insulator circumferentially surrounded by the conductive outer housing 602', and a conductive mating contact (male pin) 610' at least partially circumferentially surrounded by an insulator. Male connector 700' may also act as a coaxial transmission medium and may include a conductive outer housing (or shroud) 602' extending circumferentially about a longitudinal axis, an insulator circumferentially surrounded by the conductive outer housing 602', and a conductive mating contact (male pin) 610' at least partially circumferentially surrounded by an insulator.

Conductive outer housings 602' and 702' may be electrically coupled to outer conductor portion 300' and mating contacts 610' and 710' may be electrically coupled to socket contact 100. Conductive outer housings 602' and 702' each may include reduced diameter portions 635' and 735', which may each act as, for example, a mechanical stop or reference plane for outer conductor portion 300'. As disclosed, male connector 600' may not be coaxial with male connector 600'. Although socket contact 100 may be adapted to flex radially, allowing for mating misalignment (gimballing) between mating contacts 610' and 710', less flexible outer shroud 300' permits only amount "X" of radial misalignment. Outer conductor 300 (see FIG. 10), due to sinuate sections 350 and arrays 310, 312 of helical cantilevered beams, may permit amount "Y" of radial misalignment. "Y" may be from 1.0 to about 3.0 times amount "X" and in exemplary embodiments may be about 1.5 to about 2.5 times amount "X."

Figure 11:
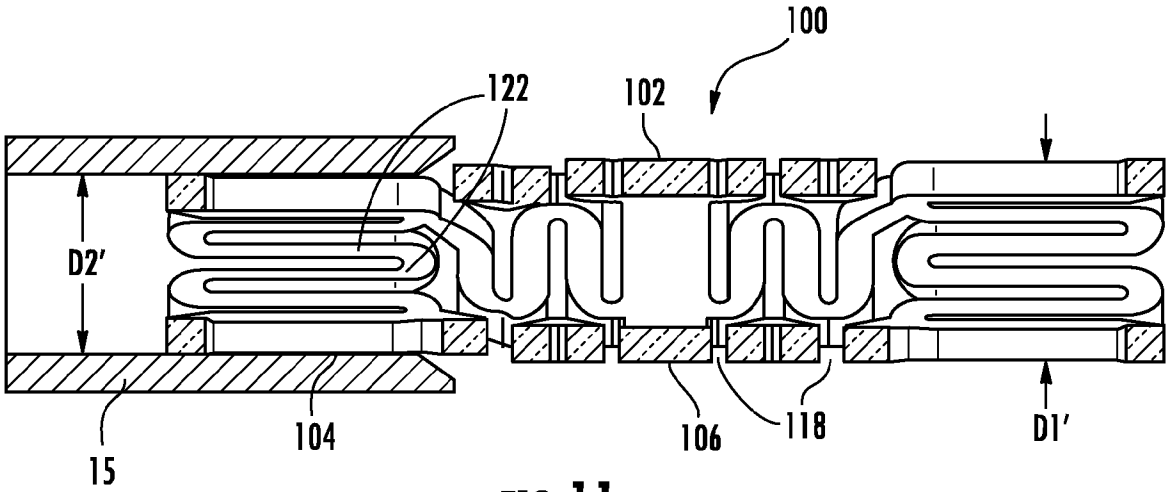
FIG. 11 is a side cross sectional view of the socket contact of FIG. 1 being mated inside of a tube instead of over a pin.

In alternate exemplary embodiments, socket contact 100 may engage a coaxial transmission medium, for example, a mating (female pin) contact 15 (FIG. 11). An outer surface of proximal portion 104 and an outer surface of distal portion 108 may each be adapted to engage, for example, circumferentially, an inner surface of mating contact 15. Prior to engagement with mating contact 10, proximal portion 104 and distal portion 108 each have an outer width, or diameter, D1' that may be larger than an inner diameter D2' of mating contact 15. In some embodiments, engagement of the outer surface of proximal portion 104 or distal portion 108 with inner surface of mating contact 15 may cause portions 104 and 108 to flex radially inwardly. As an example, during such engagement, the outer diameter of proximal portion 104 and/or distal portion 108 may be at least equal to D2' (FIG. 11). In the example, outer diameter of proximal portion 104 may be approximately equal to D2' upon engagement with mating contact 15 while distal portion 108 not being engaged to a mating contact may have an outer diameter of D1'. Disengagement of the outer surface of proximal portion 104 and/or distal portion 108 with the inner surface of mating contact 15 may cause outer diameter of proximal portion 104 and/or distal portion 108 to return to D1'. While not limited, D1'/D2' may be, in exemplary embodiments, at least 1.05, such as at least 1.1, and further such as at least 1.2, and yet further such as at least 1.3. The inward radial flexing of proximal portion 104 and/or distal portion 108 during engagement with mating contact 15 may result in a radially outward biasing force of socket contact 100 on mating contact 15, facilitating transmission of an electrical signal between socket contact 100 and mating contact 15 and also reducing the possibility of unwanted disengagement between socket contact 100 and mating contact 15.

In exemplary embodiments, the outer surface of proximal portion 104 and the outer surface of distal portion 108 are adapted to contact the inner surface of mating contact 15 upon engagement with mating contact 15. In exemplary embodiments, proximal portion 104 and distal portion 108 may each have a circular or approximately circular shaped cross-section of uniform or approximately uniform inner diameter of D1' along their longitudinal lengths prior to or subsequent to engagement with mating contact 15. In exemplary embodiments, proximal portion 104 and distal portion 108 may each have a circular or approximately circular shaped cross-section of uniform or approximately uniform outer diameter of at least D2' along a length of engagement with mating contact 15. Put another way, the region bounded by outer surface of proximal portion 104 and the area bounded by outer surface of distal portion 108 each, in exemplary embodiments, approximates that of a cylinder having outer diameter of D1' prior to or subsequent to engagement with mating contact 15, and the region bounded by inner surface of proximal portion 104 and the area bounded by inner surface of distal portion 108 each, in exemplary embodiments, approximates that of a cylinder having a outer diameter of D2' during engagement with mating contact 15.

Figure 12:
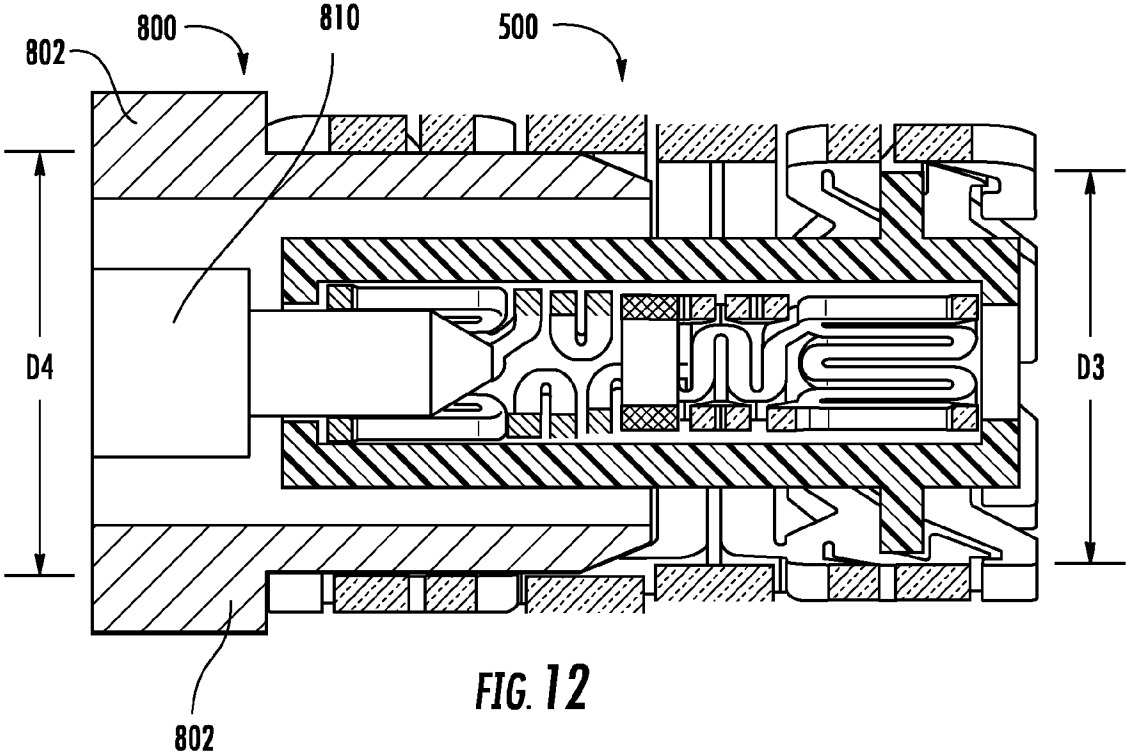
FIG. 12 is a side cross sectional view the blind mate interconnect of FIG. 5 showing an alternate mating configuration with the outer conductor mating over an outside diameter rather than within an inside diameter.

In some embodiments, blind mater interconnect 500 may engage a coaxial transmission medium, for example, a mating (male pin) contact 800 (FIG. 12) having a male outer housing or shroud 802. An inner surface of proximal portion 104 and an inner surface of distal portion 108 may each be adapted to engage, for example, circumferentially, an outer surface of mating contact 810 and an inner surface of proximal portion 302 and an inner surface of distal portion 304 of outer conductor 300 may engage an outer surface of male outer housing 802. Prior to engagement with male outer housing 802, proximal portion 302 and distal portion 304 each have an inner width, or diameter, D3 that may be smaller than an outer diameter D4 of male outer housing 802. In some embodiments, engagement of the inner surface of proximal portion 302 or distal portion 304 with outer surface of male outer housing 802 may cause portions 302 and 304 to flex radially outwardly. As an example, during such engagement, the inner diameter of proximal portion 302 and/or distal portion 304 may be at least equal to D4 (FIG. 12). In the example, inner diameter of proximal portion 302 may be approximately equal to D4 upon engagement with male outer housing 802 while distal portion 304 not being engaged to a male outer housing may have an inner diameter of D3. Disengagement of the inner surface of proximal portion 302 and/or distal portion 304 with the outer surface of male outer housing 802 may cause inner diameter of proximal portion 302 and/or distal portion 304 to return to D3. While not limited, D4/D3 may be, in exemplary embodiments, at least 1.05, such as at least 1.1, and further such as at least 1.2, and yet further such as at least 1.3. The outward radial flexing of proximal portion 302 and/or distal portion 304 during engagement with male outer housing 802 may result in a radially inward biasing force of outer conductor 300 on male outer housing 802, facilitating transmission of an electrical signal between outer conductor 300 and male outer housing 802 and also reducing the possibility of unwanted disengagement between outer conductor 300 and male outer housing 802.

In exemplary embodiments, mating performance and electrical contact may be improved by increasing the length of cantilevered arms on the socket contact and wrapping the arms around a centroidal axis. This may increase the amount of physical contact of the arm to the coaxial transmission medium and mitigate strain on the arm during deflection, for example, in a mated condition.

Figure 13:
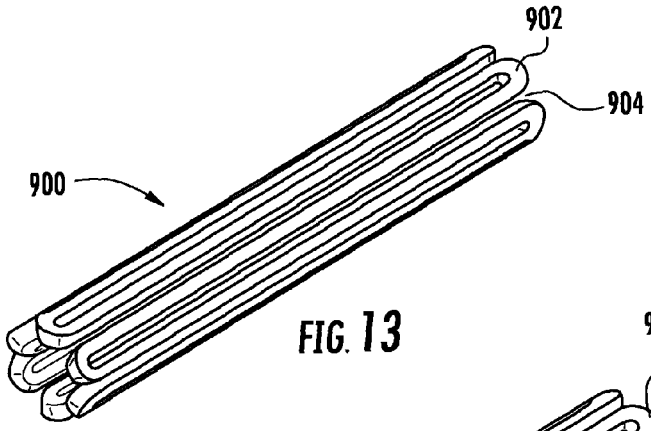
FIG. 13 is a perspective view of an alternate socket contact embodiment having a serpentine pattern.
Figure 14:
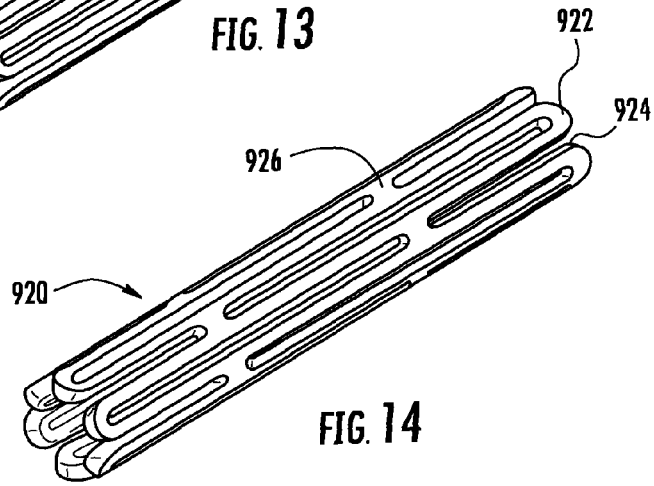
FIG. 14 is a perspective view of another alternate socket contact embodiment havein a serpentine pattern and lateral supports.
Figure 15:
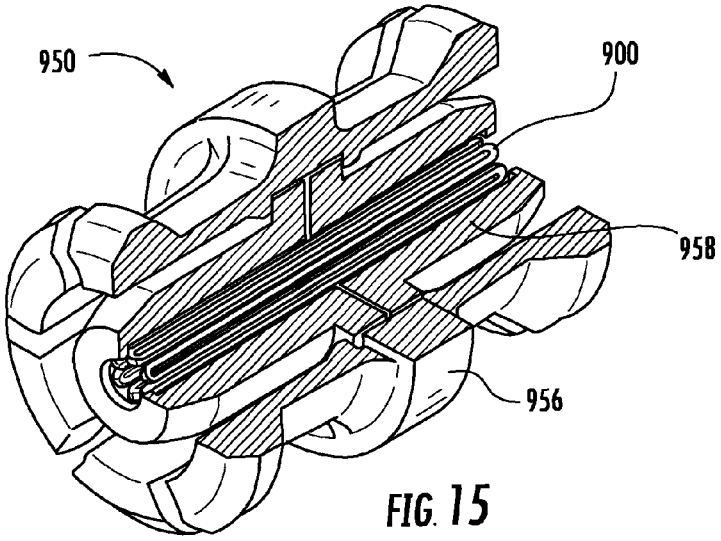
FIG. 15 is a cut-away perspective view of a blind mate interconnect showing the alternate contact embodiment of FIG. 13.

In some embodiments, a socket contact 900 (FIG. 13) may have a serpentine 902, or undulating pattern that sweeps along the entire length of contact 900. Spaces 904 alternate around the periphery of contact 900, extending from an open side to a closed side uninterrupted, for example, and allowing unhindered expansion under mating conditions. In another embodiment, another socket contact 920 (FIG. 14) may have a similar serpentine 922 pattern, and may include one or more lateral cross braces 926 that may serve to limit axial expansion under mating conditions. Placement of cross braces 926 may vary according to such requirements of the mating pin outer diameter, and may influence the length of spaces 924. By way of example, socket contact 900 may reside inside a BMI connector 950 having such an outer conductor 950 and insulators 958 (FIG. 15).

Figure 16:
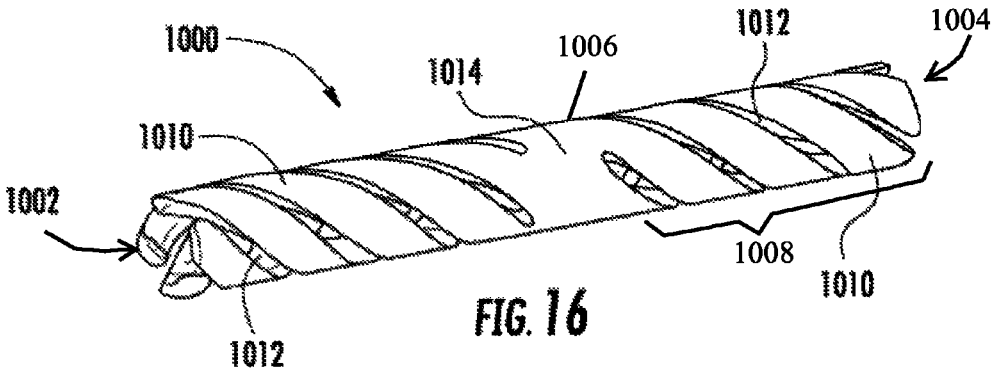
FIG. 16 is a perspective view of yet another alternate socket contact embodiment having a helical pattern.

In other exemplary embodiments, a socket contact 1000 (FIG. 16), may include a first end 1002, a second end 1004 opposite first end 1002 and a tubular body 1006 between first end 1002 and second end 1004. Contact 1000, in exemplary embodiments, may have at least one slotted region 1008. Slotted region 1008 may have at least one cantilevered arm 1010 adjoining at least one slot 1012 and extending from a medial region 1014, for example, to first end 1002. In exemplary embodiments, an array of slots 1012, for example, four slots 1012 may be arrayed around socket contact 1000.

Figure 17:
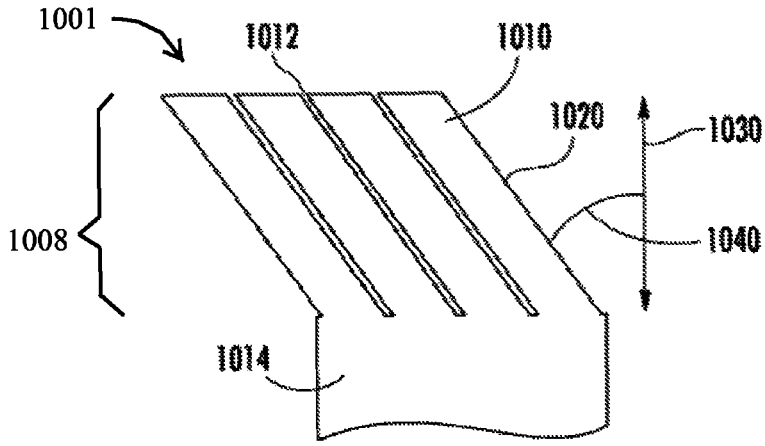
FIG. 17 is a schematic of a portion of a socket contact sliced longitudinally and unrolled to a flat configuration.

Cantilevered arm 1010 may define, for example, an angular cantilevered arm 1010 (FIG. 17), angular cantilevered arm 1010 extending at an angle greater than zero degrees to a representative longitudinal axis 1030. By way of example, a flat schematic portion 1001 of a part of contact 1000, for example, sliced longitudinally through medial region 1014 and laid flat, e.g., unrolled, may illustrate the angular nature of angular cantilevered arm 1010. Angular slots 1012 may be cut by a cutting means, for example, a laser or electro-mechanical discharge unit or some other suitable cutting means, from first end 1002 to medial region 1014 at an angle 1040 relative to a representative longitudinal axis 1030. In some embodiments, angular slots 1012 may be, for example, less than 90 degrees relative to axis 1030. In yet other embodiments, angular slots 1012 may be, for example, less than 60 degrees relative to axis 1030, and in yet other embodiments, angular slots 1012 may be from about 20 degrees to about 30 degrees relative to the axis. By way of example, angular slots 1012 may be about 25 degrees relative to axis 1030.

Slotted region 1008 may define a first length a first length from the end of slots 1012 proximal to medial region 1014, along axis 1030 that may extend from first end 1002 to second end 1004. In exemplary embodiments, cantilevered arm 1010 (FIG. 17) may define a second length along cantilevered arm 1010, for example, along an edge 1020 of cantilevered arm 1010, the second length being longer than the first length. By way of example, the second length may be from 100 percent to about 200 percent of the first length. In other embodiments, the second length may be from about 100 percent to about 150 percent of the first length. In yet other embodiments, the second length may be from about 100 percent to about 125 percent the first length. And in yet other embodiments, the second length may be from about 100 percent to about 110 percent of the first length. For example, the second length may be about 108% of the first length. Put another way, the second length may be 8% longer than the first length. This may improve mating cycle performance. For example, cantilevered arm 1010, having a free end (ends 1002, 1004) and a fixed end (at medial region 1014), may flex along its entire length. As may be appreciated, a longer cantilevered arm may encounter less bending stress along its length than a short cantilevered arm for the same amount of deflection.

In exemplary embodiments, angular cantilevered arm 1010 may wrap around, for example, at a steady distance from the centroidal axis of tubular body 1006, as angular cantilevered arm 1010 extends from medial region 1014 to, for example, first end 1002 or second end 1004. For example, most of the internal surface of angular cantilevered arm 1010 may be from about 0.003 inches to about 0.005 inches from the centroidal axis, and in some embodiments may not deviate from a set distance, or radius, by more than 0.001 inches along the internal surface in an unmated condition. In an exemplary embodiment, an array of angular cantilevered arms 1010 may wrap around the centroidal axis, giving the appearance of a helical like arrangement.

Figure 18:
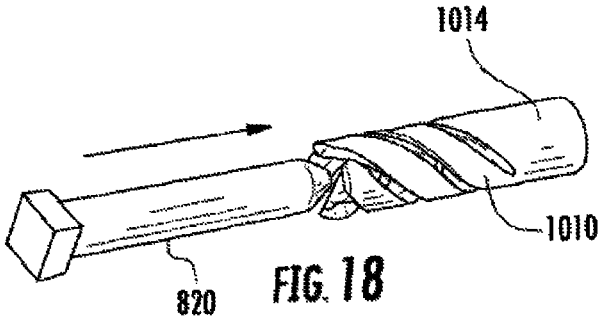
FIG. 18 is a perspective view of a portion of the socket contact of FIG. 16 interacting with a coaxial transmission medium.
Figure 19:
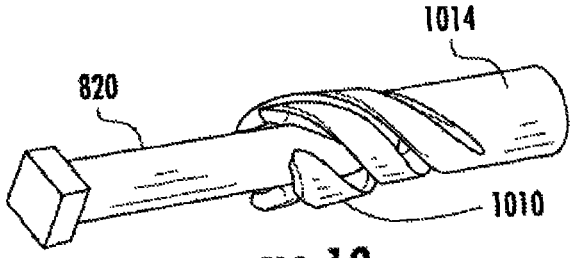
FIG. 19 is a perspective view of the interaction of FIG. 17 after mating.
Figure 20:
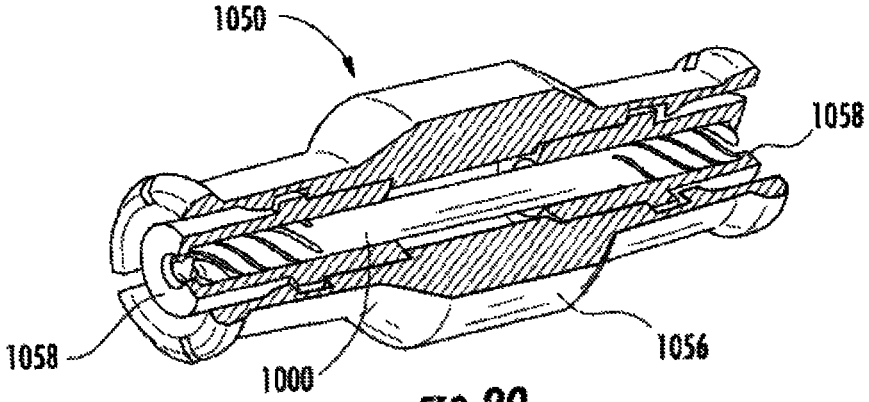
FIG. 20 is a cut-away perspective view of another blind mate interconnect showing the socket contact of FIG. 16.

Slotted region 1008 may receive, for example, a mating contact pin 820 (FIGS. 18 and 19), for example, a coaxial transmission medium, defining a contact region. At any point in the interaction of pin 820, the length of cantilevered arm 1010 along, for example, edge 1020, that engages pin 820 is longer than an interaction length 1009 by the same relative ratios as the second length to the first length, until interaction length 1009 equals the first length. By way of example, socket contact 1000 may reside inside a BMI connector 1050 having such an outer conductor 1056 and insulators 1058 (FIG. 20).

It will be apparent to those skilled in the art that various modifications and variations can be made without departing from the spirit or scope of the disclosure. Since modifications combinations, sub-combinations and variations of the disclosed embodiments incorporating the spirit and substance of the disclosure may occur to persons skilled in the art, the disclosure should be construed to include everything within the scope of the appended claims and their equivalents.

What is claimed is:

1. A coaxial socket contact for connecting to a coaxial transmission medium to form an electrically conductive path between the transmission medium and the coaxial socket contact, the coaxial socket contact comprising:

a first end;

a second end opposite the first end;

a tubular body between the first end and the second end, the tubular body having a perimeter and a medial region;

at least one slotted region, the slotted region comprising at least one cantilevered arm extending from the medial region to at least the first end, the slotted region defining a first length along an axis extending from the first end to the second end, the at least one cantilevered arm defining a second length along the at least one cantilevered arm, the second length being longer than the first length for improving mating cycle performance; and at least one longitudinally oriented U-shaped slot in the at least one slotted region.

2. The socket contact of claim 1, the second length being from 100 percent to about 200 percent of the first length.

3. The socket contact of claim 2, the second length being from 100 percent to about 150 percent of the first length.

4. The socket contact of claim 3, the second length being from 100 percent to about 125 percent the first length.

5. The socket contact of claim 4, the second length being from 100 percent to about 110 percent of the first length.

6. The socket contact of claim 1, the at least one cantilevered arm including at least one angular cantilevered arm that extends from the medial region to at least the first end, the at least one angular cantilevered arm extending at an angle greater than zero degrees to the axis.

7. The socket contact of claim 6, the at least on angular cantilevered arm wrapping around the axis as the arm extends from the medial region to the first end.

8. The socket contact of claim 6, wherein the at least one angular cantilevered arm wraps around the axis at a distance of from about 0.003 inches to about 0.005 inches from the axis as the arm extends from the medial region to at least the first end.

9. The socket contact of claim 8, the second length being measured along an edge of the angular cantilevered arm.

10. The socket contact of claim 8, the at least one angular cantilevered arm comprising a plurality of angular cantilevered arms arranged in at least one radial array.

11. The socket contact of claim 10, the plurality of angular cantilevered arms defining four angular cantilevered arms.

12. The socket contact of claim 10, the at least one array of angular cantilevered arms being defined by at least one radial array of angular slots starting at the first end and extending along the slotted region and wrapping around the axis.

13. The socket contact of claim 12, the at least one radial array of angular slots wrapping around the axis at a generally constant radius from the axis.

14. The socket contact of claim 12, the angular slots being less than 90 degrees relative to the axis.

15. The socket contact of claim 14, the angular slots being less than 60 degrees relative to the axis.

16. The socket contact of claim 14, the angular slots being from about 20 degrees to about 30 degrees relative to the axis.

17. A coaxial socket contact for connecting to a coaxial transmission medium to form an electrically conductive path between the transmission medium and the coaxial socket contact, the coaxial socket contact comprising:

a first end;

a second end opposite the first end;

a tubular body between the first end and the second end, the tubular body having a perimeter and a medial region;

at least one slotted region, the slotted region including at least one angular slot starting at the first end and extending along the slotted region and wrapping around an axis extending from the first end to the second end, the slotted region defining a first length along the axis;

at least one angular cantilevered arm that extends at an angle greater than zero degrees to the axis, the angular cantilevered arm extending from the medial region to at least the first end, the at least one angular cantilevered arm defining a second length along the at least one cantilevered arm, the second length being longer than the first length for improving mating cycle performance; and at least one longitudinally oriented U-shaped slot in the at least one slotted region.

18. The contact of claim 17, wherein the at least one angular cantilevered arm wraps around the axis at a distance of from about 0.003 inches to about 0.005 inches from the axis as the arm extends from the medial region to at least the first end.

19. The socket contact of claim 17, the second length being from 100 percent to about 110 percent of the first length.

20. The socket contact of claim 17, the angular slots being from about 20 degrees to about 30 degrees relative to the axis.

* * * * *